US009863174B2

(12) United States Patent
Banik

(10) Patent No.: US 9,863,174 B2
(45) Date of Patent: Jan. 9, 2018

(54) HINGE ROD TRAP FOR A COLLAPSIBLE BIN

(71) Applicant: ORBIS Corporation, Oconomowoc, WI (US)

(72) Inventor: Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 4 days.

(21) Appl. No.: 14/743,248

(22) Filed: Jun. 18, 2015

(65) Prior Publication Data

US 2015/0368946 A1 Dec. 24, 2015

Related U.S. Application Data

(60) Provisional application No. 62/014,791, filed on Jun. 20, 2014.

(51) Int. Cl.

| | |
|---|---|
| ***E05D 5/14*** | (2006.01) |
| ***B65D 6/18*** | (2006.01) |
| ***E05D 5/04*** | (2006.01) |

(52) U.S. Cl.

CPC ..... *E05D 5/14* (2013.01); *B65D 11/1833* (2013.01); *E05D 5/04* (2013.01); *E05D 2005/145* (2013.01)

(58) Field of Classification Search

CPC . B65D 11/18; B65D 11/1806; B65D 11/1833; B65D 19/18; B65D 43/167; E05D 3/00; E05D 5/04; E05D 5/14; E05D 7/1011; E05D 2005/145

USPC ..... 220/6; 16/355, 356, 382

See application file for complete search history.

(56) References Cited

U.S. PATENT DOCUMENTS

| | | | |
|---|---|---|---|
| 489,711 | A | 1/1893 | Mandioni |
| 1,039,452 | A | 9/1912 | Shepard |
| 1,280,629 | A | 10/1918 | Appleby |
| 1,381,013 | A | 6/1921 | Rainsford |
| 1,883,553 | A | 10/1932 | Chain |
| 2,579,655 | A | 12/1951 | Donald |
| 3,246,828 | A | 4/1966 | Branscum et al. |
| 3,572,535 | A | 3/1971 | Kinzie |
| 3,628,683 | A | 12/1971 | Friedrich et al. |

(Continued)

FOREIGN PATENT DOCUMENTS

| | | | |
|---|---|---|---|
| CA | 1319118 | A1 | 6/1993 |
| CA | 2665281 | A1 | 11/2009 |

(Continued)

OTHER PUBLICATIONS

Russian Federal Institute of Industrial Property, International Search Report and Written Opinion of International Searching Authority for PCT/US2015/036447, dated Nov. 5, 2015 (6 pages).

(Continued)

*Primary Examiner* — Fenn C Mathew
*Assistant Examiner* — Madison L Poos
(74) *Attorney, Agent, or Firm* — Greensfelder, Hemker & Gale, P.C.

(57) ABSTRACT

A collapsible bulk bin container having a flexible rib positioned to trap a hinge rod inserted between a base portion and a side wall of the container is provided. The flexible rib is moveable from a first position blocking an opening of a hinge rod channel to a second position allowing insertion or removal of the hinge rod.

21 Claims, 7 Drawing Sheets

(56) References Cited

U.S. PATENT DOCUMENTS

| | | | |
|---|---|---|---|
| 3,692,342 | A | 9/1972 | Scallan |
| 3,747,794 | A | 7/1973 | Bitney |
| 3,870,185 | A | 3/1975 | Sanders et al. |
| 3,874,546 | A | 4/1975 | Sanders et al. |
| 3,924,293 | A | 12/1975 | Cain |
| 3,977,044 | A | 8/1976 | Mort |
| 4,044,910 | A | 8/1977 | Box |
| 4,063,330 | A | 12/1977 | Triplette |
| 4,089,417 | A | 5/1978 | Osborne |
| 4,119,263 | A | 10/1978 | Cuthbertson et al. |
| 4,186,841 | A | 2/1980 | Buckley et al. |
| 4,192,430 | A | 3/1980 | Cornou |
| 4,300,695 | A | 11/1981 | Hsu |
| 4,349,121 | A | 9/1982 | Lafferty |
| 4,454,946 | A | 6/1984 | Yokowo |
| 4,466,541 | A | 8/1984 | Tabler et al. |
| 4,491,231 | A | 1/1985 | Heggeland et al. |
| 4,571,774 | A | 2/1986 | Hinson |
| 4,591,065 | A | 5/1986 | Foy |
| 4,674,647 | A | 6/1987 | Gyenge et al. |
| 4,765,480 | A | 8/1988 | Malmanger |
| 4,775,068 | A | 10/1988 | Reiland et al. |
| 4,798,304 | A | 1/1989 | Rader |
| 4,828,132 | A | 5/1989 | Francis, Jr. et al. |
| 4,863,062 | A | 9/1989 | Holliday |
| 4,917,255 | A | 4/1990 | Foy et al. |
| 4,923,079 | A | 5/1990 | Foy |
| 4,960,223 | A | 10/1990 | Chiang et al. |
| 4,967,927 | A | 11/1990 | Reiland et al. |
| 4,987,639 | A | 1/1991 | Baiuley et al. |
| 5,094,356 | A | 3/1992 | Miller |
| 5,114,037 | A | 5/1992 | Hillis et al. |
| 5,150,806 | A | 9/1992 | Glomski |
| 5,199,592 | A | 4/1993 | Reiland et al. |
| 5,289,935 | A | 3/1994 | Hillis et al. |
| 5,398,835 | A | 5/1995 | Blinstrub |
| 5,467,885 | A | 11/1995 | Blinstrub |
| 5,474,197 | A | 12/1995 | Hillis et al. |
| 5,501,353 | A | 3/1996 | Warren |
| 5,535,482 | A | 7/1996 | Grabber |
| 5,538,178 | A | 7/1996 | Zink et al. |
| 5,586,675 | A | 12/1996 | Borsboom et al. |
| 5,632,392 | A | 5/1997 | Oh |
| D381,513 | S | 7/1997 | Brauner |
| 5,660,291 | A | 8/1997 | Dash |
| 5,673,791 | A | 10/1997 | Jamison |
| 5,711,444 | A | 1/1998 | Meacham et al. |
| 5,725,119 | A | 3/1998 | Bradford et al. |
| 5,769,230 | A | 6/1998 | Koefelda |
| 5,788,103 | A | 8/1998 | Wagner et al. |
| 5,797,508 | A | 8/1998 | Loftus et al. |
| 5,845,799 | A | 12/1998 | Deaton |
| 5,850,935 | A | 12/1998 | Luburic et al. |
| 5,897,012 | A | 4/1999 | Sortwell |
| 5,908,135 | A | 6/1999 | Bradford et al. |
| 5,938,059 | A | 8/1999 | Luburic |
| 5,975,324 | A | 11/1999 | Schmitt |
| 6,000,604 | A | 12/1999 | Lapoint, III |
| 6,015,056 | A | 1/2000 | Overholt et al. |
| 6,029,839 | A | 2/2000 | Mansouri |
| 6,029,840 | A | 2/2000 | Brauner |
| 6,062,410 | A | 5/2000 | Bradford et al. |
| 6,088,239 | A | 7/2000 | Zeiss |
| 6,135,287 | A | 10/2000 | Hartwall |
| 6,138,851 | A | 10/2000 | Townson |
| 6,186,932 | B1 | 2/2001 | Vallot |
| 6,189,695 | B1 | 2/2001 | Ching-rong |
| 6,209,742 | B1 | 4/2001 | Overholt et al. |
| 6,216,872 | B1 | 4/2001 | Haasbroek |
| 6,216,899 | B1 | 4/2001 | Vicari |
| 6,223,903 | B1 | 5/2001 | Mansouri |
| 6,230,916 | B1 | 5/2001 | Bradford et al. |
| 6,234,315 | B1 | 5/2001 | Karpisek |
| 6,243,920 | B1 | 6/2001 | Sauve |
| 6,293,418 | B1 | 6/2001 | Ogden et al. |
| 6,283,319 | B1 | 9/2001 | Hillis et al. |
| 6,290,081 | B1 | 9/2001 | Merey |
| 6,293,417 | B1 | 9/2001 | Varfeldt |
| 6,305,566 | B1 | 10/2001 | Pigott et al. |
| 6,305,726 | B1 | 10/2001 | LeTrudet |
| 6,367,630 | B1 | 4/2002 | Elskamp |
| 6,386,388 | B1 | 5/2002 | Overholt |
| 6,398,054 | B1 | 6/2002 | Overholt et al. |
| 6,405,888 | B1 | 6/2002 | Overholt et al. |
| 6,415,938 | B1 | 7/2002 | Karpisek |
| 6,416,271 | B1 | 7/2002 | Pigott et al. |
| 6,422,409 | B2 | 7/2002 | Kofod |
| 6,446,825 | B1 | 9/2002 | Godoy |
| 6,460,717 | B1 | 10/2002 | Smyers et al. |
| 6,484,898 | B2 | 11/2002 | Hillis et al. |
| RE37,915 | E | 12/2002 | Lapoint, III |
| D452,614 | S | 12/2002 | Overholt |
| 6,540,096 | B1 | 4/2003 | Bazany et al. |
| 6,543,659 | B2 | 4/2003 | Blair |
| 6,601,724 | B1 | 8/2003 | Koefelda et al. |
| 6,631,822 | B1 | 10/2003 | Overholt |
| 6,669,044 | B2 | 12/2003 | Murakami et al. |
| 6,691,885 | B2 | 2/2004 | Brown |
| 6,726,046 | B2 | 4/2004 | Orset |
| 6,776,300 | B2 | 8/2004 | Walsh et al. |
| 6,783,032 | B2 | 8/2004 | Fons |
| 6,783,058 | B2 | 8/2004 | Quaintance |
| 6,786,394 | B2 | 9/2004 | Prince |
| 6,805,254 | B2 | 10/2004 | Tanzer et al. |
| 6,820,761 | B1 | 11/2004 | Mouri et al. |
| 6,838,616 | B2 | 1/2005 | Harrison et al. |
| 6,863,180 | B2 | 3/2005 | Apps et al. |
| 6,868,979 | B2 | 3/2005 | Rader |
| 6,877,628 | B2 | 4/2005 | Nesting |
| 6,899,242 | B2 | 5/2005 | Overholt et al. |
| 6,902,061 | B1 | 6/2005 | Elstone |
| 6,918,502 | B1 | 7/2005 | Overholt et al. |
| 6,955,273 | B2 | 10/2005 | Hartwall |
| 6,966,449 | B2 | 11/2005 | Williams |
| 7,011,225 | B2 | 3/2006 | Oster et al. |
| 7,017,765 | B2 | 3/2006 | Overholt |
| 7,017,766 | B2 | 3/2006 | Hsu et al. |
| 7,032,765 | B2 | 4/2006 | Miller et al. |
| 7,044,319 | B2 | 5/2006 | Overholt et al. |
| 7,048,135 | B2 | 5/2006 | Smyers et al. |
| 7,059,489 | B2 | 6/2006 | Apps et al. |
| 7,063,223 | B2 | 6/2006 | Iwahara et al. |
| 7,083,369 | B2 | 8/2006 | Nyeboer |
| 7,100,786 | B2 | 9/2006 | Smyers |
| 7,104,414 | B2 | 9/2006 | Apps et al. |
| 7,128,209 | B2 | 10/2006 | Bringard et al. |
| 7,128,231 | B2 | 10/2006 | Overholt |
| 7,137,522 | B2 | 11/2006 | Dubois |
| 7,156,249 | B2 | 1/2007 | Heinrichs |
| 7,159,730 | B2 | 1/2007 | Rumple |
| 7,195,127 | B2 | 3/2007 | Hsu et al. |
| 7,258,232 | B2 | 8/2007 | Bradford et al. |
| 7,264,122 | B2 | 9/2007 | Koefelda et al. |
| 7,287,661 | B2 | 10/2007 | Knutsson et al. |
| 7,311,220 | B2 | 12/2007 | Kellerer |
| 7,331,480 | B1 | 2/2008 | Nolan |
| 7,347,328 | B2 | 3/2008 | Hartwall |
| 7,357,269 | B2 | 4/2008 | Apps |
| 7,357,271 | B2 | 4/2008 | Hase et al. |
| 7,370,771 | B2 | 5/2008 | Rader |
| 7,416,092 | B2 | 8/2008 | Dubois et al. |
| 7,438,197 | B2 | 10/2008 | Yamauchi |
| 7,478,734 | B2 | 1/2009 | Vargas |
| 7,484,634 | B2 | 2/2009 | Apps |
| 7,540,390 | B2 | 6/2009 | Bublitz et al. |
| 7,549,550 | B2 | 6/2009 | Smyers et al. |
| 7,556,165 | B2 | 7/2009 | McDade |
| 7,556,166 | B2 | 7/2009 | Parnall et al. |
| 7,708,160 | B2 | 5/2010 | Booth et al. |
| 7,748,330 | B2 | 7/2010 | Dubois et al. |
| 7,774,919 | B2 | 8/2010 | Bublitz et al. |
| 7,828,167 | B2 | 11/2010 | Nolan |
| 7,841,487 | B2 | 11/2010 | Miller et al. |
| 7,861,458 | B2 | 1/2011 | Apps et al. |

(56) References Cited

U.S. PATENT DOCUMENTS

| | | | |
|---|---|---|---|
| 7,861,879 | B2 | 1/2011 | Apps et al. |
| 7,870,970 | B2 | 1/2011 | Fisk |
| 8,109,402 | B2 | 2/2012 | Hartwall |
| 8,181,806 | B2 | 5/2012 | Hidalgo Vargas |
| 8,210,379 | B2 | 7/2012 | Afflerbach et al. |
| 8,267,270 | B2 | 9/2012 | Samprathi |
| 8,308,015 | B2 | 11/2012 | Bradford |
| 8,413,831 | B2 | 4/2013 | Nolan |
| 8,434,618 | B2 | 5/2013 | Mitchell et al. |
| 8,485,376 | B2 | 7/2013 | Samprathi |
| 8,511,496 | B2 | 8/2013 | Ringler |
| 8,727,158 | B2 | 5/2014 | Nolan |
| 8,727,165 | B2 | 5/2014 | Nolan |
| 8,820,558 | B2 | 9/2014 | Van der Korput et al. |
| 8,820,560 | B2 | 9/2014 | Nolan |
| 8,915,397 | B2 | 12/2014 | Petersen et al. |
| 2002/0108950 | A1 | 8/2002 | Moorman et al. |
| 2004/0065699 | A1 | 4/2004 | Schoer et al. |
| 2005/0103797 | A1 | 5/2005 | Rader et al. |
| 2006/0011627 | A1 | 1/2006 | Overholt et al. |
| 2007/0029319 | A1 | 2/2007 | Speck |
| 2007/0056967 | A1 | 3/2007 | Dobrinski et al. |
| 2007/0056977 | A1 | 3/2007 | Dobrinski et al. |
| 2007/0068941 | A1 | 3/2007 | Dubois |
| 2007/0075077 | A1 | 4/2007 | Dubois |
| 2007/0095842 | A1 | 5/2007 | Apps |
| 2007/0140684 | A1 | 6/2007 | Tsang |
| 2007/0181587 | A1 | 8/2007 | Burnham |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0017638 | A1 | 1/2008 | Bradford |
| 2008/0116199 | A1 | 5/2008 | Bublitz et al. |
| 2008/0116201 | A1 | 5/2008 | Baltz |
| 2008/0169285 | A1 | 7/2008 | Marazita et al. |
| 2009/0134176 | A1 | 5/2009 | Yamauchi |
| 2009/0152265 | A1 | 6/2009 | Nolan |
| 2009/0205169 | A1 | 8/2009 | Nolan et al. |
| 2010/0018966 | A1 | 1/2010 | Roberts, Sr. et al. |
| 2010/0038331 | A1 | 2/2010 | Ydstrom |
| 2010/0072199 | A1 | 3/2010 | Manuel |
| 2010/0239730 | A1 | 9/2010 | Ditter |
| 2010/0275426 | A1 | 11/2010 | Bublitz et al. |
| 2011/0127275 | A1 | 6/2011 | Dubois |
| 2011/0139775 | A1 | 6/2011 | Nolan |
| 2011/0259884 | A1 | 10/2011 | Kellerer et al. |
| 2012/0152798 | A1 | 6/2012 | Allegretti et al. |
| 2012/0205369 | A1 | 8/2012 | Nolan |
| 2012/0318692 | A1 | 12/2012 | Kellerer |
| 2013/0048522 | A1 | 2/2013 | Lorenz et al. |
| 2013/0221003 | A1 | 8/2013 | Carver et al. |
| 2014/0042175 | A1 | 2/2014 | Nolan |
| 2014/0069949 | A1* | 3/2014 | Niemann ..... B65D 43/14 220/840 |
| 2014/0117035 | A1 | 5/2014 | Petersen et al. |
| 2014/0252018 | A1 | 9/2014 | Nolan |
| 2015/0069055 | A1 | 3/2015 | Jennings |
| 2015/0136765 | A1 | 5/2015 | Banik |
| 2015/0144625 | A1 | 5/2015 | Banik et al. |
| 2015/0175351 | A1 | 6/2015 | Petersen et al. |

FOREIGN PATENT DOCUMENTS

| | | | |
|---|---|---|---|
| CN | 20090355384.9 | | 7/2010 |
| CN | 200930355382.X | | 7/2010 |
| CN | 200930355383.4 | | 7/2010 |
| CN | 201020111642.6 | | 11/2010 |
| CN | 201020145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 4/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0830291 | A1 | 3/1998 |
| EP | 0768229 | B1 | 7/1999 |
| EP | 0962396 | A1 | 12/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1652646 | A2 | 5/2006 |
| EP | 1440011 | B1 | 6/2006 |
| EP | 1472147 | B1 | 9/2006 |
| EP | 1746036 | A1 | 1/2007 |
| EP | 1827942 | A2 | 9/2007 |
| EP | 1927552 | A2 | 6/2008 |
| EP | 1935792 | A1 | 6/2008 |
| EP | 1616803 | B1 | 10/2009 |
| EP | 2845818 | A1 | 3/2015 |
| EP | 2876054 | A1 | 5/2015 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| JP | 03381677 | A | 12/2002 |
| KR | 1999-0061830 | | 7/1999 |
| MX | 321125 | | 6/2014 |
| SE | 323908 | B | 5/1970 |
| SE | 522095 | C2 | 1/2004 |
| WO | 9640564 | A1 | 12/1996 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |
| WO | 2009023830 | A1 | 2/2009 |

OTHER PUBLICATIONS

U.S. Patent & Trademark Office, International Search Report and Written Opinion of International Searching Authority for PCT/US08/73306 dated Nov. 24, 2008 (7 pages).

Korean Intellectual Property Office, International Search Report for PCT/US2013/067243 dated Feb. 7, 2014 (3 pages).

U.S. Patent & Trademark Office, International Preliminary Report on Patentability and Written Opinion of International Searching Authority for PCT/US2008/073306 dated Feb. 16, 2010 (6 pages).

Korean Intellectual Property Office, Written Opinion of International Searching Authority for PCT/U52013/067243 dated Feb. 7, 2014 (4 pages).

European Patent Office, Extended European Search Report for EP 14194964 dated Mar. 27, 2015 (6 pages).

European Patent Office, Extended European Search Report for EP 14183992.8 dated Jan. 30, 2015 (8 pages).

* cited by examiner

HINGE ROD TRAP FOR A COLLAPSIBLE BIN

CROSS-REFERENCE TO RELATED APPLICATIONS

The present application claims the benefit of Provisional Application Ser. No. 62/014,791, filed Jun. 20, 2014, the contents of which are incorporated herein by reference.

FEDERALLY SPONSORED RESEARCH OR DEVELOPMENT

N/A

FIELD OF THE INVENTION

The present invention generally relates to a collapsible bulk bin having a flexible rib for enabling insertion of a hinge rod and trapping the hinge rod after installation.

BACKGROUND OF THE INVENTION

Collapsible bulk bin containers include side walls that are hingedly connected to a base portion. This allows the side wall to move from an upright position to a collapsed position by rotating about the hinge connection.

Many hinges utilize a hinge rod which is inserted through an opening in the base portion of the container into a channel. The hinge rod is threaded between hinge elements in the base portion and the side wall.

To keep the hinge rod from falling out during use, a screw plug or other similar structure is inserted into the opening of the channel holding the hinge rod. This can be a problem because the screw can loosen and fall out, or it can crack the portion of the base portion holding the screw. The cracking can occur because of hoop stresses from installation of the screw plug and shrinkage of the base portion.

The present system provides an improved bulk bin container with structure for trapping the hinge rod without the need for screw plugs.

SUMMARY OF THE INVENTION

The present invention provides a bulk bin container with collapsible side walls. The container includes a base portion with a flexible rib positioned to trap a hinge rod.

In accordance with one embodiment, a collapsible bulk bin container with a hinge trap is provided. The collapsible bulk bin container comprises a base portion having a first side, a second side, a third side and a fourth side, the sides forming a first corner between the first side and second side, a second corner between the second side and third side, a third corner between the third side and fourth side, and a fourth corner between the fourth side and first side. A channel is provided along the first side of the base portion for supporting a hinge rod. The channel includes an opening at a first end proximate the first corner. A first flexible rib is connected to the first corner proximate the opening. The first flexible rib is moveable from a first position blocking the opening to a second position allowing access to the opening.

The collapsible bulk bin container further comprises a first rib support for holding the first flexible rib. The rib support and flexible rib can extend at an angle of approximately 45° from the first corner with respect to the first side wall.

The first flexible rib can extend from a position below the opening to a position above the opening. Alternatively, the first flexible rib can extend part way across the opening.

The first flexible rib and the first rib support can be integrally formed with the base portion. The first flexible rib, the first rib support and the base portion can be formed from plastic.

The first rib support can extend between a first lower, horizontal platform in the first corner of the base portion to a second, upper horizontal platform in the first corner of the base portion.

Each of the corners can be provided with a flexible rib and rib support. Alternatively, two opposing corners can be provided with a flexible rib having a first segment and a second segment. In this latter configuration, the opening for the hinge rod for two sides would each be on the corner where the flexible rib is, typically at different heights.

In accordance with another embodiment, a bulk bin container with a hinge rod trap is provided. The bulk bin container comprises a rectangular base portion having a support surface. A first plurality of hinge rod channel segments extends along a first side of the base portion. The first plurality of hinge rod channel segments is configured to receive and hold a hinge rod connecting a first side wall to the base portion. The bulk bin container further includes a first flexible rib segment positioned proximate a first end of the first plurality of hinge rod segments. The first flexible rib segment is positioned and configured such that flexing of the first rib segment allows for one of insertion or removal of a hinge rod. The first flexible rib segment blocks the opening of the hinge rod channel segments and prevents removal of a hinge rod when in an un-flexed condition.

The bulk bin container can include a first support rib connected to the first flexible rib segment. The first support rib holds the first flexible rib segment in the proper position to block the opening to prevent a hinge rod from being removed.

The bulk bin container is preferably formed from a molded plastic. The base portion can include a plurality of ribs. The support surface can be formed from the plurality of ribs. In this instance, the first plurality of hinge rod channel segments can be formed in the ribs forming the support surface of the base portion.

The hinge rod channel segments in the base portion are spaced apart a sufficient distance from each other to allow placement of hinge elements from a first side wall between the hinge rod channel segments. The hinge elements from the side wall include channels that aligned with the channels in the base portion.

The bulk bin container can further include a second plurality of hinge rod channel segments configured to receive and hold a hinge rod connecting a second side wall to the base portion. A second flexible rib segment is positioned proximate a first end of the second plurality of hinge rod segments. A second support rib can be connected to the second flexible rib. Moreover, each side of the base portion can include a plurality of hinge rod channels and an associated flexible rib and support rib.

The flexible ribs preferably extend at an angle with respect to the side edges of the base portion. In accordance with one embodiment, the flexible rib can extend at a 45° angle with respect to a side edge of the base portion.

The base portion of the bulk bin container is preferably formed from plastic in a molding operation. The flexible rib segments and support ribs are preferably integrally formed as part of the base portion of the bulk bin container.

Further aspects of the invention are disclosed in the Figures, and are described in the written description and claims herein.

BRIEF DESCRIPTION OF THE DRAWINGS

To understand the present invention, it will now be described by way of example, with reference to the accompanying drawings in which.

DETAILED DESCRIPTION

Figure 1:
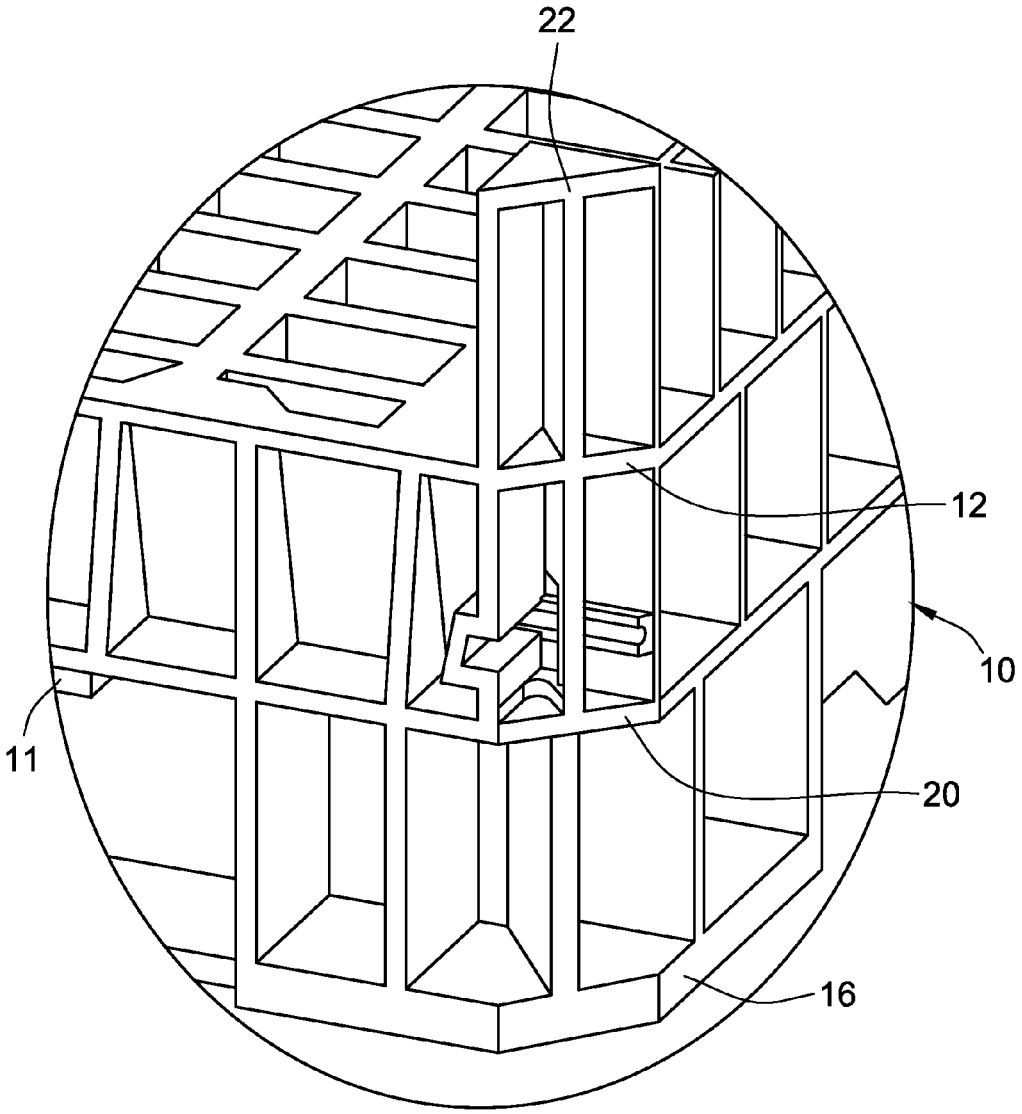
FIG. 1 is a perspective view of a corner of a collapsible bulk bin having a flexible rib for trapping a hinge rod in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

FIGS. 1-5 illustrate a flexible rib structure 10 for use in a collapsible bulk bin container 12. The bulk bin container 12 is preferably formed from plastic. The bulk bin container 12 includes a generally square or rectangular base portion 11 having four sides and four corners (only a first corner of the base portion 11 is shown in FIGS. 1-5). Each side of the bulk bin 12 includes a side wall that is hingedly connected to the base portion 11. Hinge rods 14 (that are inserted into hinge elements on the base portion 11 and side walls) are typically used as part of the connection between the base portion 11 and the side walls. The hinge rods 14 can be metal or other suitable material.

The flexible rib structure 10 allows for trapping a hinge rod 14 in one of the sides of the base portion 11. The hinge rod 14 is used with cooperating hinge elements in the base portion 11 and the side walls, to allow the side walls of the bulk bin container 12 to rotate from an upright position to a collapsed position and back again.

Figure 2:
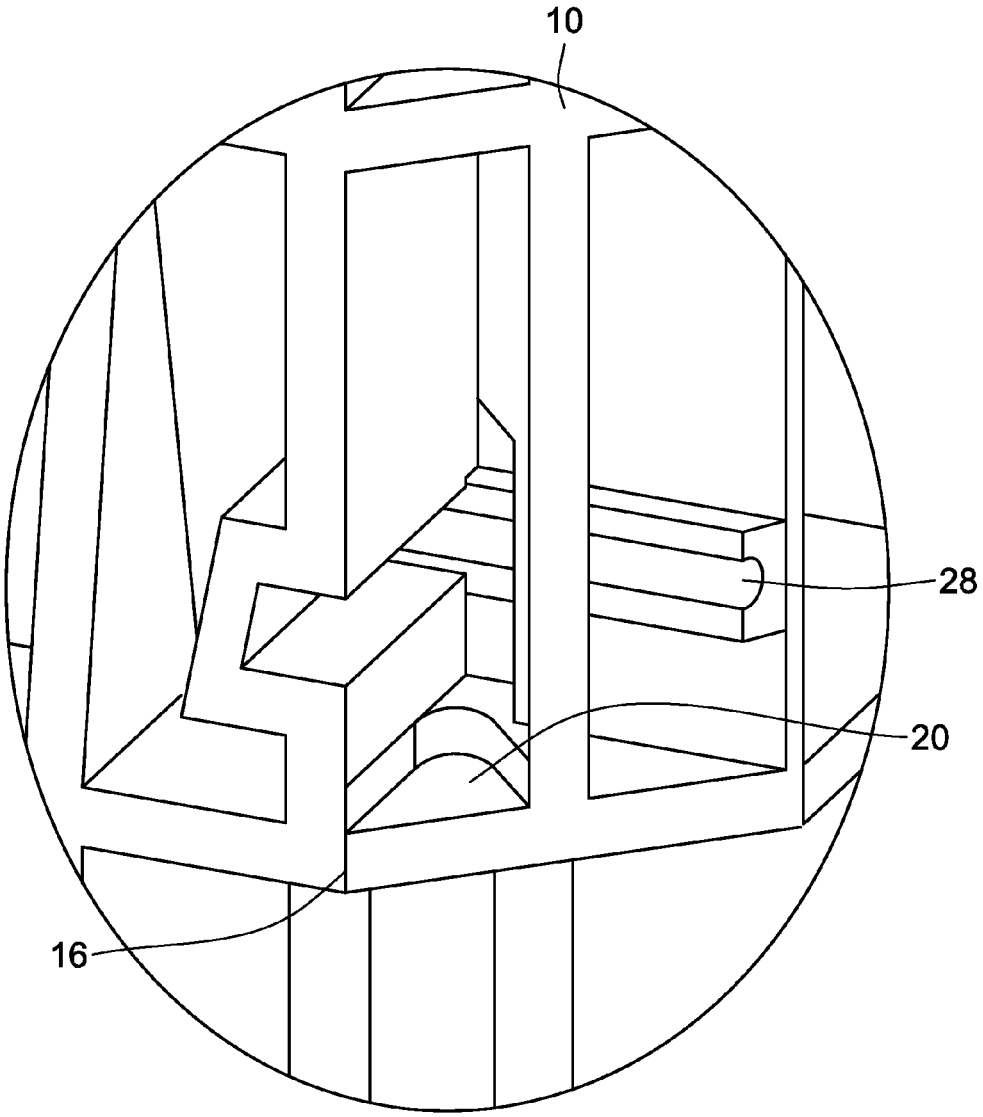
FIG. 2 is an enlarged perspective view of a portion of the corner of the collapsible bulk bin of FIG. 1.
Figure 3:
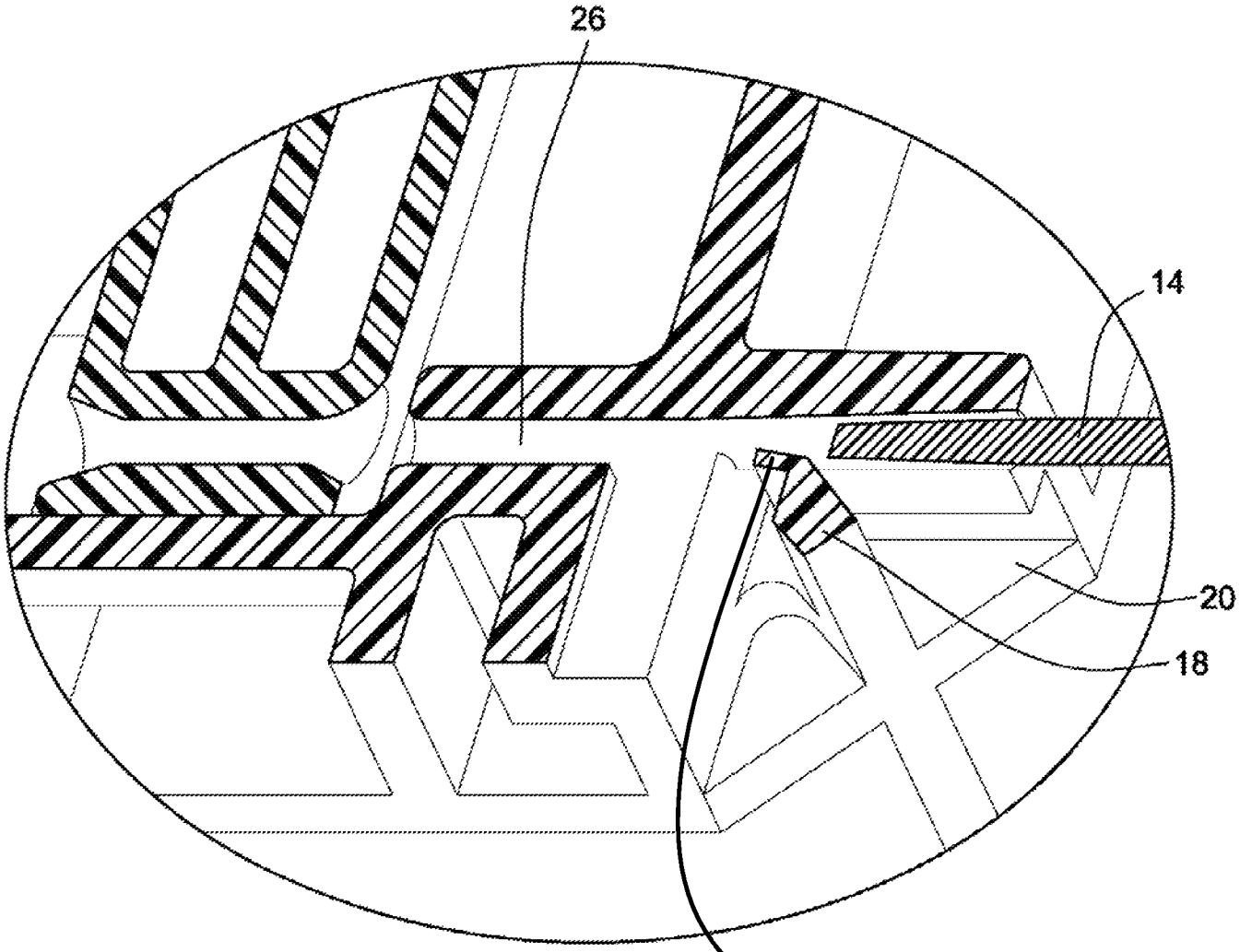
FIG. 3 is a cross-sectional perspective view of the corner of the collapsible bulk bin of FIG. 1 showing a hinge rod prior to insertion.

Referring to FIGS. 2 and 3, the flexible rib structure 10 includes a rib support 18 positioned at a corner 16 of the base portion 11. The rib support 18 extends between a first lower horizontal planar portion 20 and a second upper horizontal planar portion 22 at an angle with respect to either of the sides forming the corner 16. In the embodiment in the Figures, the rib support 18 is at an angle of approximately 45°.

The rib support 18 is connected to a flexible rib 24 positioned proximate an end of a cylindrical hinge rod channel 26. A hinge rod cradle 28 extends outward along a vertical planar wall or rib and is co-extensive with the hinge rod channel 26. The cradle and channel 28, 26 locate the hinge rod 14 at the proper height for the hinge elements in the base portion 11 and the side wall.

Figure 4:
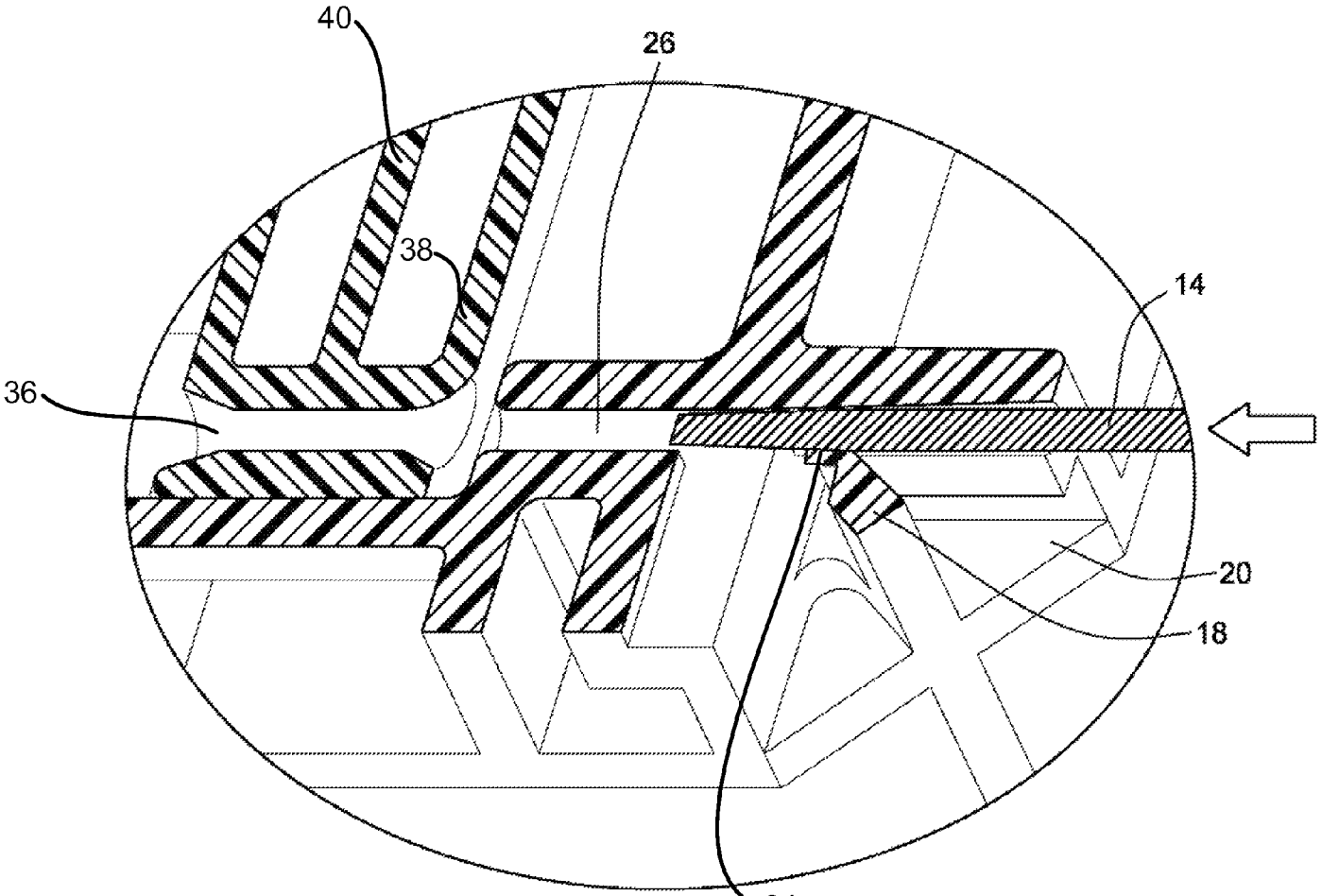
FIG. 4 is a cross-sectional perspective view of the corner of the collapsible bulk bin of FIG. 1 showing the hinge rod partially inserted.
Figure 5:
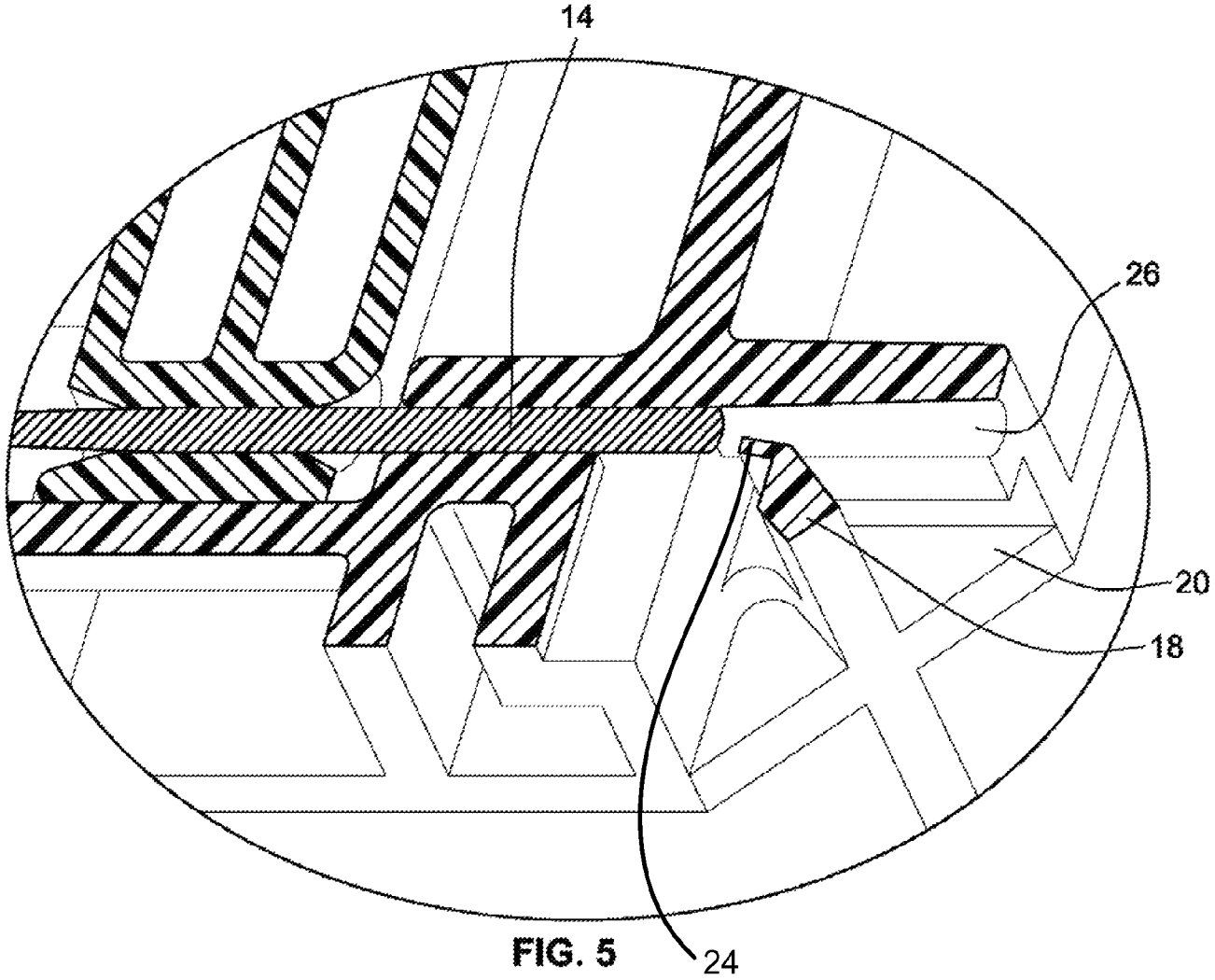
FIG. 5 is a cross-sectional perspective view of the corner of the collapsible bulk bin of FIG. 1 with the hinge rod inserted and trapped by the flexible rib.

As shown in FIGS. 3 and 4, as the hinge rod 14 is inserted into the hinge rod channel 26, the flexible rib 24 moves (i.e., flexes) to allow the hinge rod 14 access to the channel 26. As illustrated in FIG. 5, once the hinge rod 14 passes the flexible rib 24, the rib moves back to block the opening of the channel 26 and prevent the hinge rod 14 from exiting or backing out during use.

The flexible rib 24 can extend the entire length of the rib support 18. However, the flexible rib 24 only needs to cover, or partly cover, the opening of the channel 26 to block the hinge rod 14 from exiting the channel 26. The flexible rib 24 and rib support 18 structures can be integrally formed with the base portion 11 of the bulk bin container 12. Alternatively, a replaceable unit (with one or both of the flexible rib 24 and the rib support 18) can be provided for use with base portion 11.

The hinge rod 14 can be removed by using a tool, such as a screw driver, to bend the flexible rib 14 to a non-blocking position, and then moving the hinge rod 14 outward. The edge of the flexible rib 24 is spaced from the opening a small distance to allow for such movement without contacting the end of the hinge rod 14.

While only one flexible rib 24 is shown, a similar configuration can be used at each corner for securing a hinge rod in each side of the bulk bin container 12. In this manner, each side wall can then be hingedly connected on each side of the base portion 11. This allows the side walls to be collapsed for transport when the bulk bin container 12 is empty.

The side walls are typically connected at different heights. This allows them to lay flat when collapsed. Accordingly, rather than having a flexible rib at each corner, a flexible rib structure can be utilized at just two (opposite) corners to cover openings for two adjacent sides of the base portion. The flexible rib can be in two segments, one configured to flex or bend in one direction for one side, and the other configured to flex or bend in the opposite direction for the other side. Because the openings are at different heights, the rib segments are positioned one on top of the other. Moreover, there can be a solid portion and/or a gap between the rib segments in this embodiment.

Figure 6:
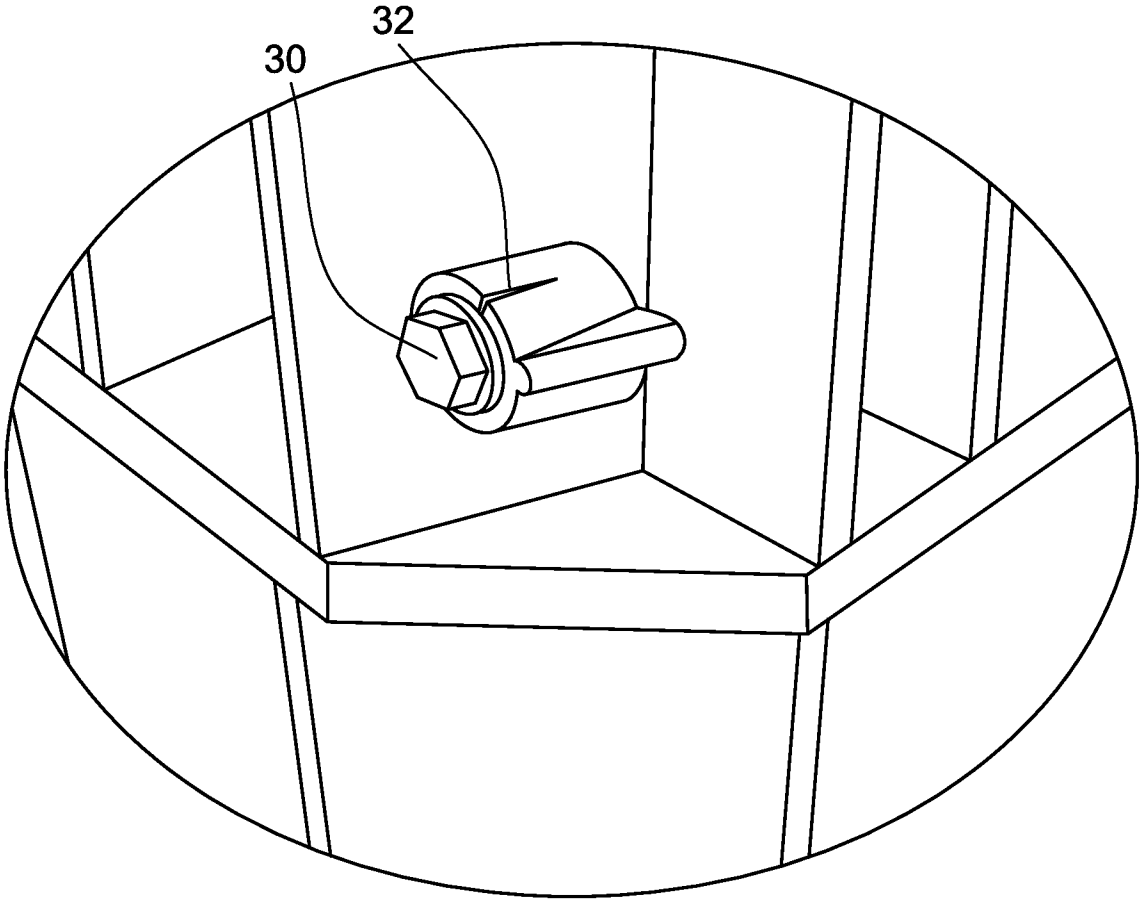
FIG. 6 is a perspective view of a corner of a prior collapsible bulk bin container with a screw plug configuration for trapping a hinge rod; and, FIG. 7 is a perspective view of a press-through hole without a screw plug.
Figure 7:
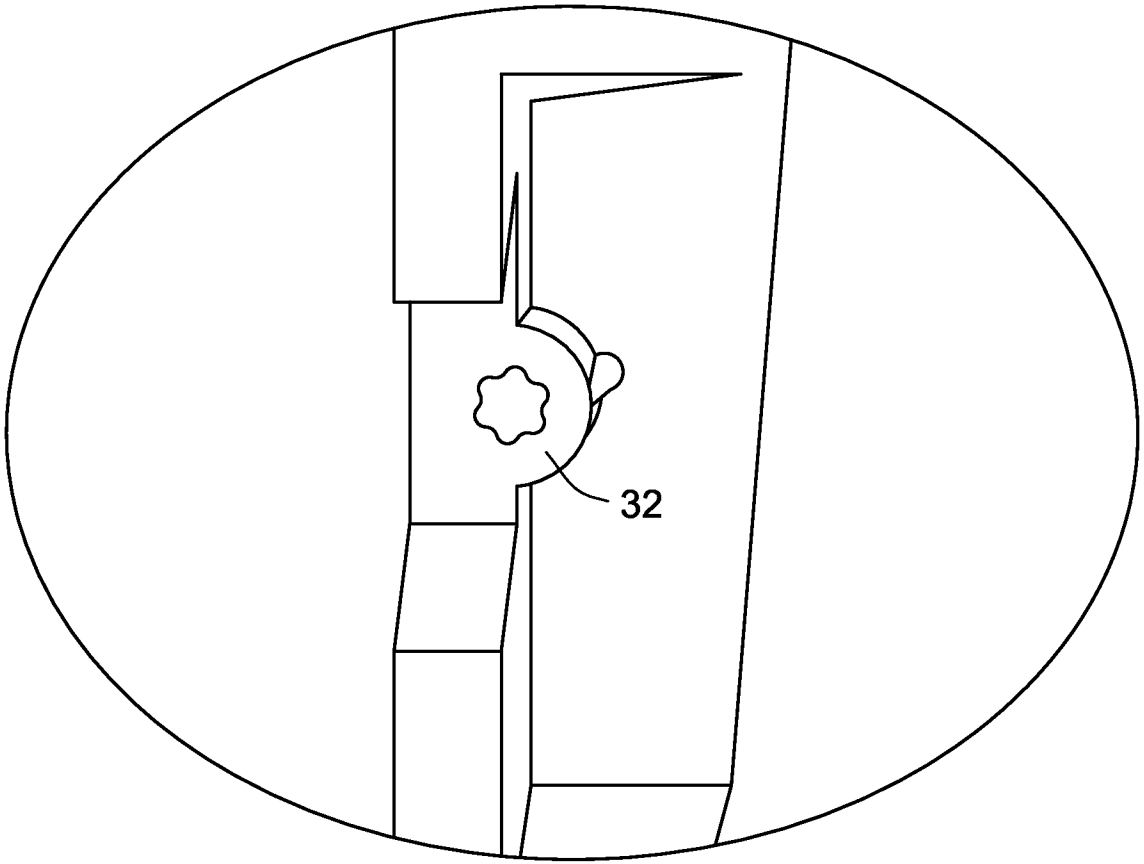

In the past, a screw 30 or other similar plug was used with a screw boss 32 to block the hinge rod 14 as shown in FIG. 6. This often resulted in cracks 34 in the boss 32. FIG. 7 shows the boss without a plug.

As illustrated in FIGS. 3-5, the hinge rod 14 is inserted past the flexible rib 24 in the corner of the base portion 11, and into the channel 26 of the base portion 11. The hinge rod 14 then travels through a side wall channel 36 of a hinge element 38 positioned at the bottom of a side wall 40 and then back into a continuation of the channel 26 of the base portion 11. Channel 26 is thus formed from a plurality of channel segments separated by areas for receiving the hinge elements 38 of the side wall 40.

In this instance, the side wall 40 is shown substantially parallel to a support surface of the base portion 11. The hinge rod 14, in combination with the hinge element 38 of the side wall 40 allows the side wall 40 to rotate to an upright position and back down to a collapsed position. There are typically two or more hinge elements 38 per side wall 40. The number and size of the hinge elements 38 in the side wall 40 depends, in part, on the size of the bulk bin 10 at issue.

Many modifications and variations of the present invention are possible in light of the above teachings. It is, therefore, to be understood within the scope of the appended claims the invention may be protected otherwise than as specifically described.

I claim:

1. A collapsible bulk bin container comprising:

a base portion having a first side, a second side, a third side and a fourth side, the sides forming a first corner between the first side and second side, a second corner between the second side and third side, a third corner between the third side and fourth side, and a fourth corner between the fourth side and first side;

a channel along the first side of the base portion that supports a hinge rod having a first end, an opposing second end and a cylindrical outer surface between the first end and the second end, the channel having an opening at a first end proximate the first corner; and, a first flexible rib connected to the first corner of the base portion proximate the opening, the first flexible rib moveable from a first position blocking the opening and preventing movement of the hinge rod in a direction along a longitudinal axis of the hinge rod to a second position allowing access to the opening and allowing movement of the hinge rod in a direction along the longitudinal axis of the hinge rod, wherein the flexible rib is configured to contact the first end of the hinge rod when in the first position.

2. The collapsible container of claim 1 further comprising a first rib support for holding the first flexible rib, wherein the first flexible rib extends from the first support rib in a direction toward an interior of the collapsible container.

3. The collapsible container of claim 1 wherein the first flexible rib extends at an angle of approximately 45° from the first corner with respect to the first side wall.

4. The collapsible container of claim 1 wherein the first flexible rib extends from a position below the opening to a position above the opening.

5. The collapsible container of claim 1 wherein the first flexible rib is integrally formed with the base portion.

6. The collapsible container of claim 2 wherein the first rib support extends between a first lower horizontal platform in the first corner of the base portion to a second upper horizontal platform in the first corner of the base portion.

7. The collapsible container of claim 6 wherein the first flexible rib extends for only a portion of the first rib support.

8. The collapsible container of claim 1 comprising a second flexible rib positioned at the second corner, a third flexible rib proximate the third corner and a fourth flexible rib proximate the fourth corner.

9. The collapsible container of claim 8 further comprising a second rib support for supporting the second flexible rib, a third rib support for supporting the third flexible rib and a fourth rib support for supporting the fourth flexible rib.

10. The collapsible container of claim 1 wherein the base portion and flexible rib are integrally formed together.

11. The collapsible container of claim 10 wherein the base portion and flexible rib are plastic.

12. A bulk bin container with a hinge rod trap comprising:

a rectangular base portion having a support surface and a first plurality of hinge rod channel segments extending along a first side of the base portion, the first plurality of hinge rod channel segments that receive and hold a hinge rod connecting a first side wall to the base portion; and, a first flexible rib segment positioned proximate a first end of the first plurality of hinge rod segments of the rectangular base portion, wherein flexing of the first rib segment allows for one of insertion and removal of a hinge rod in a direction along a longitudinal axis of the hinge rod, and wherein the first rib segment is positioned to contact an end of a cylindrical hinge rod and block removal of the hinge rod in a direction along the longitudinal axis of the hinge rod when in an un-flexed condition.

13. The bulk bin container of claim 12 further comprising a first support rib connected to the first flexible rib segment, wherein the first flexible rib extends from the first support rib in a direction toward an interior of the bulk bin container.

14. The bulk bin container of claim 12 wherein the support surface is formed from a plurality of ribs.

15. The bulk bin container of claim 14 wherein the first plurality of hinge rod channel segments are formed in the ribs forming the support surface of the base portion.

16. The bulk bin container of claim 12 wherein the hinge rod channel segments in the base portion are spaced apart a sufficient distance to allow placement of hinge elements from a first side wall between the hinge rod channel segments.

17. The bulk bin container of claim 12 comprising:

a second plurality of hinge rod channel segments configured to receive and hold a hinge rod connecting a second side wall to the base portion; and, a second flexible rib segment positioned proximate a first end of the second plurality of hinge rod segments.

18. The bulk bin container of claim 17 comprising a second support rib connected to the second flexible rib segment.

19. The bulk bin container of claim 12 wherein the first flexible rib segment extends at a 45° angle with respect to a side edge of the base portion.

20. The bulk bin container of claim 12 wherein the base is plastic.

21. A collapsible bulk bin container comprising:

a base portion having a first side, a second side, a third side and a fourth side, the sides forming a first corner between the first side and second side, a second corner between the second side and third side, a third corner between the third side and fourth side, and a fourth corner between the fourth side and first side;

a channel along the first side of the base portion for supporting a hinge rod, the channel having an opening at a first end proximate the first corner;

a first flexible rib connected to the first corner of the base portion proximate the opening, the first flexible rib moveable from a first position blocking the opening and preventing movement of the hinge rod in a direction along a longitudinal axis of the hinge rod to a second position allowing access to the opening and allowing movement of the hinge rod in a direction along the longitudinal axis of the hinge rod; and, a first rib support for holding the first flexible rib, wherein the first flexible rib extends from the first support rib in a direction toward an interior of the collapsible container.

* * * * *